US005908359A

United States Patent [19]

Shimosaka et al.

[11] Patent Number: 5,908,359

[45] Date of Patent: Jun. 1, 1999

[54] GOLF BALL HAVING IMPROVED SYMMETRY

[75] Inventors: Hirotaka Shimosaka; Keisuke Ihara; Atuki Kasasima; Michio Inoue; Yutaka Masutani, all of Chichibu, Japan

[73] Assignee: Bridgestone Sports Co., Ltd., Tokyo, Japan

[21] Appl. No.: 08/979,955

[22] Filed: Nov. 26, 1997

Related U.S. Application Data

[63] Continuation-in-part of application No. 08/756,651, Nov. 26, 1996, abandoned.

[30] Foreign Application Priority Data

Nov. 28, 1995 [JP] Japan ..... 7-332821
Nov. 13, 1996 [JP] Japan ..... 8-317107

[51] Int. Cl.[6] ..... A63B 37/14

[52] U.S. Cl. ..... 473/384

[58] Field of Search ..... 473/384, 383

[56] References Cited

U.S. PATENT DOCUMENTS

| | | | |
|---|---|---|---|
| 5,092,604 | 3/1992 | Oka | 473/384 X |
| 5,156,404 | 10/1992 | Oka et al. | 473/384 X |
| 5,332,226 | 7/1994 | Kim | 473/384 |
| 5,507,493 | 4/1996 | Sullivan et al. | 273/230 |
| 5,518,246 | 5/1996 | Moriyama et al. | 473/384 |
| 5,527,043 | 6/1996 | Shimosaka | 473/384 |
| 5,569,100 | 10/1996 | Molitor et al. | 473/384 |
| 5,575,477 | 11/1996 | Hwang | 473/384 X |

*Primary Examiner*—George J. Marlo
*Attorney, Agent, or Firm*—Sughrue, Mion, Zinn, Macpeak & Seas, PLLC

[57] ABSTRACT

The present invention provides a golf ball of improved symmetry by regulating volume, area, edge length and array symmetry indexes Vi, Si, Li, and Ni obtained from coordinates (θj, φj) of a dimple center as represented by the latitude (in radian) and longitude of the ball and a radius rj and a volume vj of a dimple, for correcting a difference in dimple effect caused by a distortion of roundness of the ball. The golf ball does not have dimples which intersect the mold parting line, and the dimples occupy at least 65% of the ball surface.

9 Claims, 6 Drawing Sheets

POLE HITTING

SEAM HITTING

GOLF BALL HAVING IMPROVED SYMMETRY

CROSS REFERENCE TO RELATED APPLICATION

This application is a continuation-in-part of application Ser. No. 08/756,651 filed on Nov. 26, 1996, now abandoned the entire contents of which are hereby incorporated by reference.

BACKGROUND OF THE INVENTION

1. Field of the Invention

This invention relates to a golf ball having improved symmetry and more particularly, to a golf ball having improved aerodynamics in that it will follow the same trajectory on both impact at a pole of the ball and seam hitting and its performance does not vary with different impact points.

2. Prior Art

The flying performance of golf balls is greatly affected by the arrangement and configuration (including diameter, depth and cross-sectional shape) of dimples. Various dimple arrangements are known in the art for arranging a plurality of dimples on the ball surface in an even or dense fashion. Typical known dimple arrangements are regular polyhedral arrangements. It is also known to equally divide the hemisphere into one to seven sections, especially three to six sections from its center.

In JP-B 7875/1994 the dimple configuration is tailored such that the overall effective volume of dimples remains substantially equal between pole hitting (the spin axis is in the equator plane) and seam hitting (the spin axis is a pole-to-pole line).

Golf balls are generally molded in an axisymmetric manner by using a mold comprising a pair of mold halves, removably mating them along a parting line to define a spherical cavity therein, and introducing stock material into the cavity. The thus molded golf balls tend to have a higher degree of roundness about a pole-to-pole axis corresponding to a line connecting the apexes of the mold half cavities, but a lower degree of roundness about an axis on a plane circumscribed by a seam line corresponding to the parting plane of the mold. Because of such roundness variation, conventional golf balls exhibit different flight performance depending on the position at which the ball is hit. Such flight performance variation raises a serious problem in the game of golf wherein the Rules of Golf prescribe that "the ball shall be played as it lies, except as otherwise provided in the Rules."

More specifically, when a golf ball is hit by a club, the ball is given back spin although the number of revolutions varies with a particular type of club. The ball hitting is generally classified into pole hitting and seam hitting depending on an impact point. Reference is now made to FIG. 6(A) and 6(B) wherein a golf ball 10 has a seam line (equator line) 12 and a center 16. The pole hitting means that the ball 10 is hit at arrow 20 to give back spin about a straight line 18 connecting two diametrically opposed points 14, 14 on the seam line 12 and the center 16 as shown in FIG. 6(A). The seam hitting means that the ball 10 is hit at arrow 26 to give back spin about a straight line 24 extending perpendicular to a circular plane 22 circumscribed by the seam line 12 and passing the center 16. As previously mentioned, in the event of pole hitting shown in FIG. 6(A), the ball is susceptible to extra lift or drag since it does not define a true circle about the spin axis 18. It is thought that the surface portion which does not define a true circle may give a dimple-like effect at the land on which dimples are not provided. On the other hand, in the event of seam hitting shown in FIG. 6(B), the ball is substantially free of extra lift or drag since it is close to a true circle about the spin axis 24. In many cases, the seam line or equator line is formed as an endless (continuous) band-like land on which any dimples do not intercept. As a consequence, if the ball is simply designed such that the effect of dimples may be equal between pole hitting and seam hitting, the effect of dimples would be greater on pole hitting because of a deviation from roundness. Then on pole hitting, the golf ball receives extra lift or drag, exhibiting different flight performance than on seam hitting. This means that the flight performance varies with a particular hit position.

To produce a golf ball which is improved in symmetry in that the flight performance remains constant regardless of a particular hit position, the arrangement and configuration of dimples must be designed in consideration of the shape or roundness of the ball so as to optimize the effect of dimples. This requirement has not been fully satisfied.

SUMMARY OF THE INVENTION

Therefore, an object of the present invention is to provide a golf ball which is improved in symmetry in that the ball will follow the same trajectory on either seam hitting or pole hitting, that is, the flight performance does not vary with a particular hit position.

To attain the above and other objects, the present invention provides a golf ball having a plurality of dimples in its surface which is molded using a mold comprising a pair of mold halves defining a hemispherical cavity and adapted to be removably mated along a parting line to define a spherical cavity therein. It is provided that the ball surface has an equator line corresponding to the mold parting line and poles at apexes opposed with respect to the equator line, the number of the dimples is n, a center of each dimple has coordinates (θj, ϕj) as represented by the latitude (in radian) and longitude of the ball, and the dimple has a radius rj and a volume vj. Symmetry indexes Vi, Si, Li, and Ni are represented by the following equations (1) to (4).

$$\text{volume symmetry index } Vi = \frac{\sum_{j=1}^{n} vj\theta j}{\sum_{j=1}^{n} vj} \tag{1}$$

$$\text{area symmetry index } Si = \frac{\sum_{j=1}^{n} rj^2\theta j}{\sum_{j=1}^{n} rj^2} \tag{2}$$

$$\text{edge length symmetry index } Li = \frac{\sum_{j=1}^{n} rj\theta j}{\sum_{j=1}^{n} rj} \tag{3}$$

$$\text{array symmetry index } Ni = \frac{\sum_{j=1}^{n} \theta j}{\sum_{j=1}^{n} 1} \tag{4}$$

The present invention requires to satisfy the following condition (A) and at least one of the following conditions (B) to (D): (A) Vi>1, preferably 1.001≦Vi≦1.025, (B) Ni>1, preferably 1.001≦Ni≦1.015, (C) Li>1, preferably 1.001≦Li≦1.025, and (D) Si>1, preferably 1.001≦Si≦1.025.

In this golf ball, any dimples do not intercept the equator line.

Preferably, all of conditions (A) to (D) are satisfied. Also preferably, all the dimples occupy at least 65% of the ball surface.

According to the invention, the ball is designed in order that the effect of dimples be equal between pole hitting and seam hitting. In consideration of the fact that the effect of dimples is different between pole hitting and seam hitting because of the difference in roundness, the design of dimple parameters including volume, area, edge length and array of dimples is made such that the effect of dimples may be different between pole hitting and seam hitting, more particularly the effect of dimples themselves is less on the pole hitting tending to allow the effect of dimples to exert because of a low degree of roundness, but the effect of dimples themselves is greater on the seam hitting tending to suppress the effect of dimples as compared with the pole hitting. Then the difference in the effect of dimples themselves is offset by an increase or decrease of the effect of dimples due to different degrees of roundness. The overall result is a uniform dimple effect.

More particularly, the symmetry indexes Vi, Si, Li, and Ni representing the symmetry of volume, area, edge length and array of dimples, respectively, are obtained by comparing the symmetry of dimples on the seam line side (a region adjacent to the seam line) and on the pole side (a region adjacent to the pole) with respect to the seam line assumed to be an equator line and numerating them. When the symmetry index is equal to unity (1), the dimple performance is equal between the seam line side and the pole side. When the symmetry index is greater than 1, the dimples on the seam line side have a greater volume, area, and edge length than on the pole side, and the dimple array is more concentrated on the seam side. That is, in the design, the dimple effect upon seam hitting is greater than upon pole hitting. Inversely, when the symmetry index is less than 1, the dimples on the pole side have a greater volume, area, and edge length than on the seam line side, and the dimple array is more concentrated on the pole side. That is, in the design, the dimple effect upon pole hitting is greater than upon seam hitting. According to the invention, design is made such that at least one of these symmetry indexes is greater than 1. The design is made such that the effect of dimples associated with the pole hitting tending to allow the effect of dimples to exert because of a low degree of roundness is lower than the effect of dimples associated with the seam hitting. Then the difference in dimple effect originally given by the dimple design offsets an increase or decrease of the dimple effect due to a different degree of roundness. As a result, an equal dimple effect is exerted between pole hitting and seam hitting, achieving satisfactory trajectory symmetry.

BRIEF DESCRIPTION OF THE DRAWINGS

These and further features of the present invention will be apparent with reference to the following description and drawings, wherein.

DETAILED DESCRIPTION OF THE INVENTION

The present invention is explained according to FIG. 1. For a golf ball having a plurality of dimples in its surface, it is provided that a line or circle on the ball surface corresponding to the mold parting line is an equator line and apexes opposed with respect to the equator line are poles.

Figure 1A:
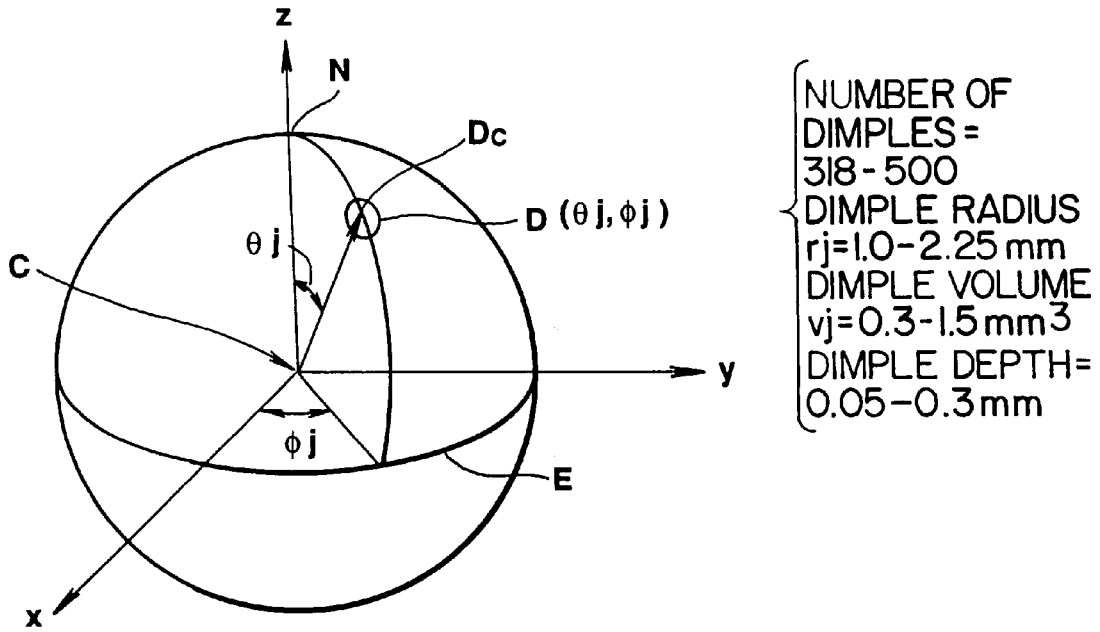
FIG. 1 illustrates the axes x, y and z, an equator, a pole, and a dimple position of a golf ball, FIG. 1(A) corresponding to the northern hemisphere of the golf ball and FIG. 1(B) corresponding to the southern hemisphere of the golf ball.
Figure 1B:
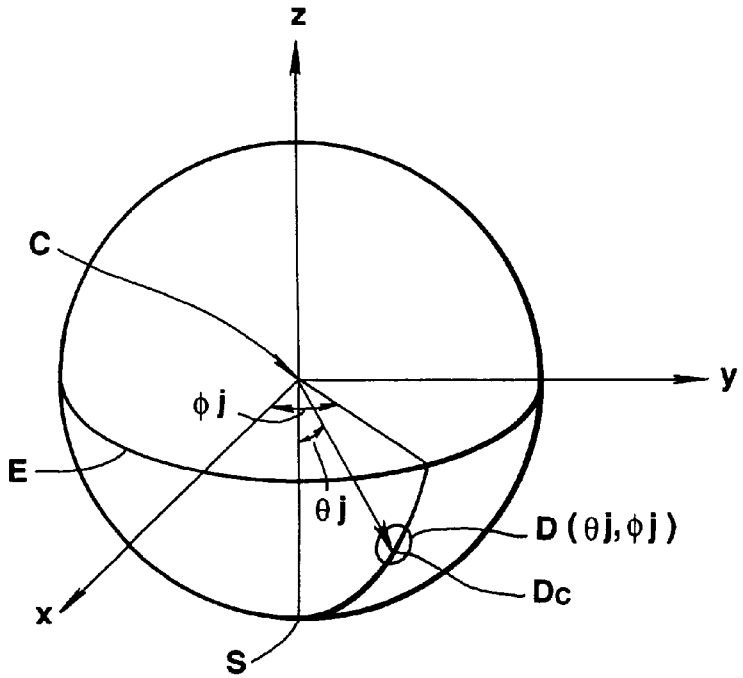

FIG. 1(A) shows the northern hemisphere portion of the golf ball and FIG. 1(B) shows the southern hemisphere portion of the golf ball. In FIG. 1(A), the axis x and the axis y are extended from the center C of the golf ball to the equator line E, and the axis z is extended from the center C of the golf ball to the north pole N. In FIG. 1(B), the axis z is extended from the center C to the south pole S.

In the golf ball of the present invention, dimples are not provided on the equator line E and the equator line E is formed as an endless or continuous band on which the dimples do not intercept.

A center Dc of each dimple D has a point of coordinates ($\theta j$, $\phi j$) as represented by the latitude (in radian) and longitude of the ball, and the dimple has a radius rj and a volume vj. According to the present invention, the dimples are designed such that symmetry index represented by equation (1) has a value in excess of 1 and at least one of symmetry indexes Si, Li, and Ni represented by equations (2) to (4) has a value in excess of 1.

The coordinates ($\theta j$, $\phi j$) of a dimple center are represented by the latitude and longitude of the ball, based on the assumption that a line on the ball surface corresponding to the mold parting line, that is, a seam line is an equator line and apexes opposed with respect to the equator line are poles. It is understood that $\theta j$ represented by the latitude of the ball is the angle expressed in radian unit between an axis connecting the north pole, ball center and south pole and a line connecting the dimple center and the ball center. Therefore, in the north hemisphere, the coordinates are commonly used polar coordinates. Since $\phi j$ represented by the longitude of the ball is not used in the calculation of the symmetry indexes, it may be expressed in conventional degree unit.

The dimple radius rj is expressed in millimeters (mm). Preferably, the diameter of dimples ranges from 2.0 to 4.5 mm, especially 2.4 to 4.1 mm, and the depth of dimples ranges from 0.005 to 0.3 mm, especially 0.08 to 0.24 mm, though not critical. The dimple volume vj is expressed in cubic millimeter ($mm^3$) and preferably ranges from 0.3 to 1.5 $mm^3$, especially 0.4 to 1.25 mm though not critical. The golf ball of the invention may have dimples of two or more types which are different in radius rj and/or volume vj. In general, the golf ball has dimples of one to six types. The total number n of dimples is not critical and may be suitably selected although 240 to 620 dimples, especially 318 to 500 dimples are preferred.

The volume symmetry index Vi is determined as equation (1) from the coordinates ($\theta j$, $\phi j$) of a center of each dimple and the volume vj thereof.

$$Vi = \frac{\sum_{j=1}^{n} vj\theta j}{\sum_{j=1}^{n} vj} \quad (1)$$

The volume symmetry index Vi indicates the symmetry of the volume of dimples formed on the ball surface between the equator line (or seam line) side and the pole side of the ball. A volume symmetry index equal to unity indicates that dimple volumes are uniformly distributed over the entire ball. A volume symmetry index of greater than 1 indicates that the dimple volume is greater on the equator or seam line side than on the pole side. A volume symmetry index of less than 1 indicates that the dimple volume is greater on the pole side than on the equator or seam line side.

In the practice of the invention, the volume symmetry index Vi is adjusted to a value in excess of 1, preferably in the range of 1.001 to 1.025, more preferably in the range of 1.002 to 1.015. Then the dimple effect is made uniform between seam hitting and pole hitting, stabilizing the trajectory. A volume symmetry index Vi in excess of 1.030 has a likelihood that under certain conditions of the remaining symmetry indexes, the dimple effect upon seam hitting is too much greater than the dimple effect upon pole hitting to render the dimple effect uniform.

The area symmetry index Si is determined as equation (2) from the coordinates (θj, ϕj) of a center of each dimple and the radius rj thereof.

$$Si = \frac{\sum_{j=1}^{n} rj^2\theta j}{\sum_{j=1}^{n} rj^2} \quad (2)$$

The area symmetry index Si indicates the symmetry of the area of dimples formed on the ball surface between the equator line (or seam line) side and the pole side of the ball. An area symmetry index equal to unity indicates that dimple areas are uniformly distributed over the entire ball. An area symmetry index of greater than 1 indicates that the dimple area is greater on the equator or seam line side than on the pole side. An area symmetry index of less than 1 indicates that the dimple area is greater on the pole side than on the equator or seam line side. It is noted that the dimple area used herein designates the plane area of a dimple as projected on a plane. If a dimple is circular in projected planar shape, for example, the dimple area is expressed by $\pi r^2$wherein r is a radius of the dimple.

It is preferred in the practice of the invention that the area symmetry index Si is adjusted to a value in excess of 1, preferably in the range of 1.001 to 1.025, more preferably in the range of 1.002 to 1.015. Then the dimple effect is made uniform between seam hitting and pole hitting, stabilizing the trajectory. An area symmetry index Si in excess of 1.030 has a likelihood that under certain conditions of the remaining symmetry indexes, the dimple effect upon seam hitting is too greater than the dimple effect upon pole hitting to render the dimple effect uniform.

The edge length symmetry index Li is determined as equation (3) from the coordinates (θj, ϕj) of a center of each dimple and the radius rj thereof.

$$Li = \frac{\sum_{j=1}^{n} rj\theta j}{\sum_{j=1}^{n} rj} \quad (3)$$

The edge length symmetry index Li indicates the symmetry of the edge length of dimples formed on the ball surface between the equator line (seam line) side and the pole side of the ball. An edge length symmetry index equal to unity indicates that dimple edge lengths are uniformly distributed over the entire ball. An edge length symmetry index of greater than 1 indicates that the dimple edge length is greater on the equator or seam line side than on the pole side. An edge length symmetry index of less than 1 indicates that the dimple edge length is greater on the pole side than on the equator or seam line side. It is noted that the dimple edge length used herein designates the peripheral length of a dimple edge. If a dimple is circular in projected planar shape, for example, the edge length is expressed by $2\pi r$ wherein r is a radius of the dimple.

It is preferred in the practice of the invention that the edge length symmetry index Li is adjusted to a value in excess of 1, preferably in the range of 1.001 to 1.025, more preferably in the range of 1.002 to 1.015. Then the dimple effect is made uniform between seam hitting and pole hitting, stabilizing the trajectory. An edge length symmetry index Li in excess of 1.030 has a likelihood that under certain conditions of the remaining symmetry indexes, the dimple effect upon seam hitting is too greater than the dimple effect upon pole hitting to render the dimple effect uniform.

The array symmetry index Ni is determined as equation (4) from the coordinates (θj, ϕj) of a center of each dimple.

$$Ni = \frac{\sum_{j=1}^{n} \theta j}{\sum_{j=1}^{n} 1} \quad (4)$$

The array symmetry index Ni indicates the symmetry of the array or distribution of dimples formed on the ball surface between the equator line (or seam line) side and the pole side of the ball. An array symmetry index equal to unity indicates that dimples are uniformly distributed over the entire ball. An array symmetry index of greater than 1 indicates that more dimples are distributed on the equator or seam line side than on the opposite pole sides. An array symmetry index of less than 1 indicates that more dimples are distributed on the opposite pole sides than on the equator or seam line side.

It is preferred in the practice of the invention that the array symmetry index Ni is adjusted to a value in excess of 1, preferably in the range of 1.001 to 1.015, more preferably in the range of 1.002 to 1.015. Then the dimple effect is made uniform between seam hitting and pole hitting, stabilizing the trajectory. An array symmetry index Ni in excess of 1.020 has a likelihood that under certain conditions of the remaining symmetry indexes, the dimple effect upon seam hitting is greater than the dimple effect upon pole hitting to render the dimple effect uniform.

In the golf ball of the present invention, dimples are designed such that the volume symmetry index Vi has a value in excess of 1 (Vi>1) and at least one of area symmetry index Si, edge length symmetry index Li, and array symmetry index Ni has a value in excess of 1. Then no difference is found in the dimple effect between seam hitting and pole hitting, and a constant trajectory is expectable. Among the dimple parameters including volume, area, edge length and array, a change of the dimple volume has the greatest influence on the dimple effect. Therefore, dimples are designed such that the volume symmetry index Vi should have a value in excess of 1, especially a value in the range of 1.001 to 1.025.

In the preferred embodiment of the invention, dimples are designed such that all the symmetry indexes Vi, Si, Li and Ni have values in excess of 1, especially values in the above-mentioned optimum ranges.

In the golf ball of the present invention, the dimple effect is regulated by taking into account a distortion of roundness of the ball and using the volume symmetry index Vi, area symmetry index Si, edge length symmetry index Li, and array symmetry index Ni as a parameter. It is further preferred that dimples are designed such that all the dimples occupy at least 65%, especially 65 to 75% of the ball surface area although the invention is not limited to a percent dimple area occupation in this range. Then the regulation of the dimple effect in terms of the respective symmetry indexes becomes more effective, ensuring that the golf ball has satisfactory trajectory symmetry and covers a longer flying distance. It is noted that the dimple area is the plane area of a dimple as explained above.

The percent dimple volume occupation given as the overall dimple volume divided by the ball volume is not critical although a percent volume occupation of about 0.6 to 1.3%, especially about 0.7 to 1.0% is preferred.

The dimple arrangement may be selected from well-known arrangements including regular octahedron, regular dodecahedron, and regular eicosahedron arrangements as well as symmetric arrangements of equally dividing the hemisphere into one to seven sections from its center. The pattern which is formed on the ball surface by arranging dimples includes various patterns such as square, hexagon, pentagon, and triangle patterns.

Dimples of one or more types may be formed on a single ball surface. Preferably, dimples of one to six types are arranged on a ball. The dimples may have any desired planar shape although circular dimples are preferred. The total number of dimples is not critical and may be determined in accordance with the arrangement, size, and planar shape of dimples and the number of dimple types. Usually, 240 to 620 dimples, especially 318 to 500 dimples are formed on a ball.

Insofar as the dimple design is regulated as defined above using the respective symmetry indexes, the golf ball of the invention may have any desired structure. The invention is applicable to solid golf balls including one-piece golf balls, two-piece golf balls, and multi-piece golf balls of three or more layer structure as well as wound golf balls. In particular, the invention is applied to those golf balls in which the roundness differs between a circle about a pole-to-pole axis and a circle about an axis in a plane circumscribed by the seam line, for example, solid golf balls of two piece or more and wound golf balls in which the cover is formed by injection molding or compression molding using a mold comprising a pair of split mold halves defining a hemispherical cavity and adapted to be removably mated to define a spherical cavity and one-piece solid golf balls which are similarly molded by injection molding or compression molding.

It is understood that the golf ball of the invention can be manufactured by conventional methods using well-known stock materials depending on the ball structure, that is, whether the ball is a solid golf ball or wound golf ball. The diameter and weight of the golf ball may be properly determined in accordance with the Rules of Golf.

EXAMPLE

Examples of the present invention are given below by way of illustration and not by way of limitation. All parts are by weight.

Examples 1–3 and Comparative Example 1

Four two-piece solid golf balls (Examples 1–3 and Comparative Example 1) were manufactured by a conventional method except that dimples were designed as reported in Table 1. In Table 1, Vi is a volume symmetry index, Si is an area symmetry index, Li is an edge length symmetry index, and Ni is an array symmetry index as defined by equations (1) to (4), respectively. The dimples were arranged on the golf balls as shown in FIGS. 2 to 5.

In FIGS. 2 to 5, numeral 1 is an equator, numeral 2 is a pole (northern pole or southern pole), and numerals 3, 4, 5 are dimples having a different size each other. Among the dimples, dimple No. 1 [ID (identification) 1] is represented by a white circle (○) dimple No. 2 [ID 2] is represented by a black circle (●), and dimple No. 3 [ID 3] is represented by an oblique line circle ⊘.

TABLE 1

Figure 2:
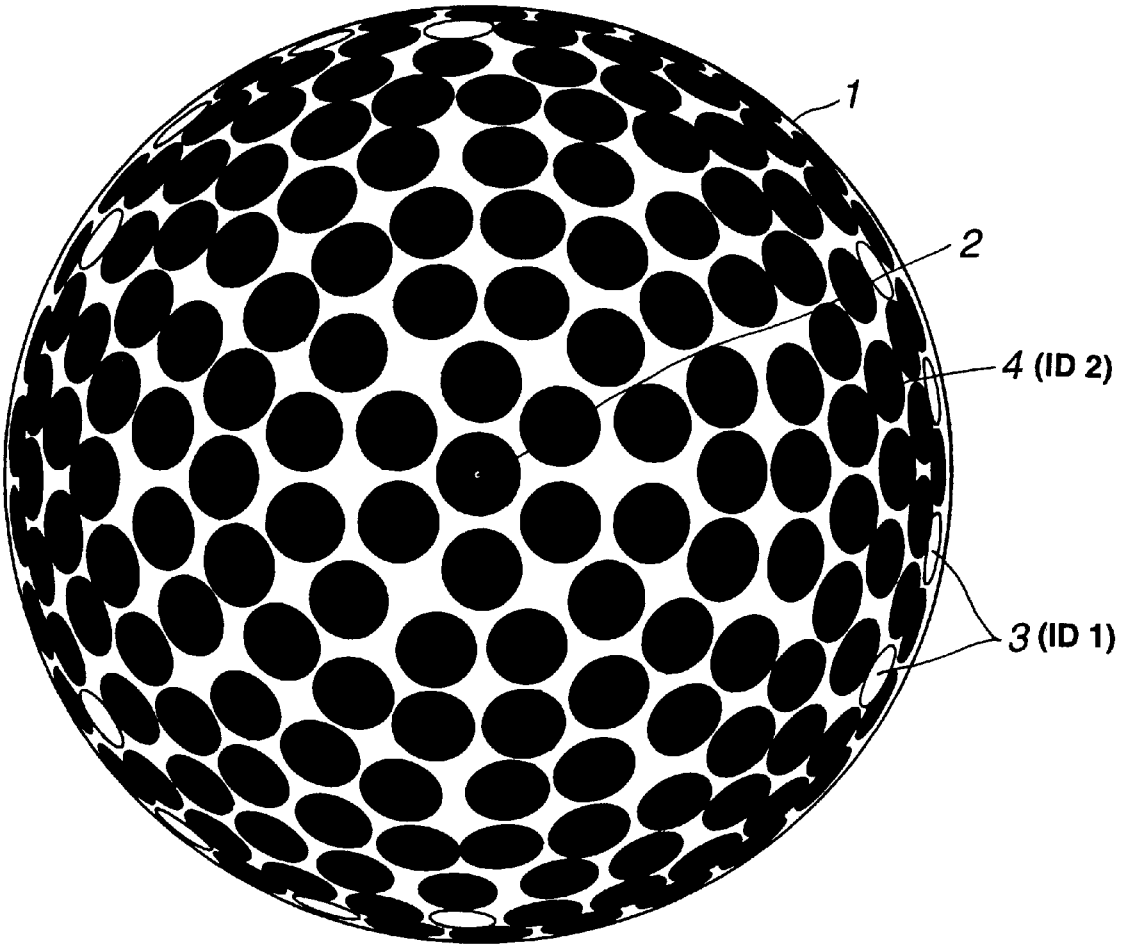
FIG. 2 schematically illustrates the pattern of dimple arrangement on a golf ball used in Example 1.
Figure 3:
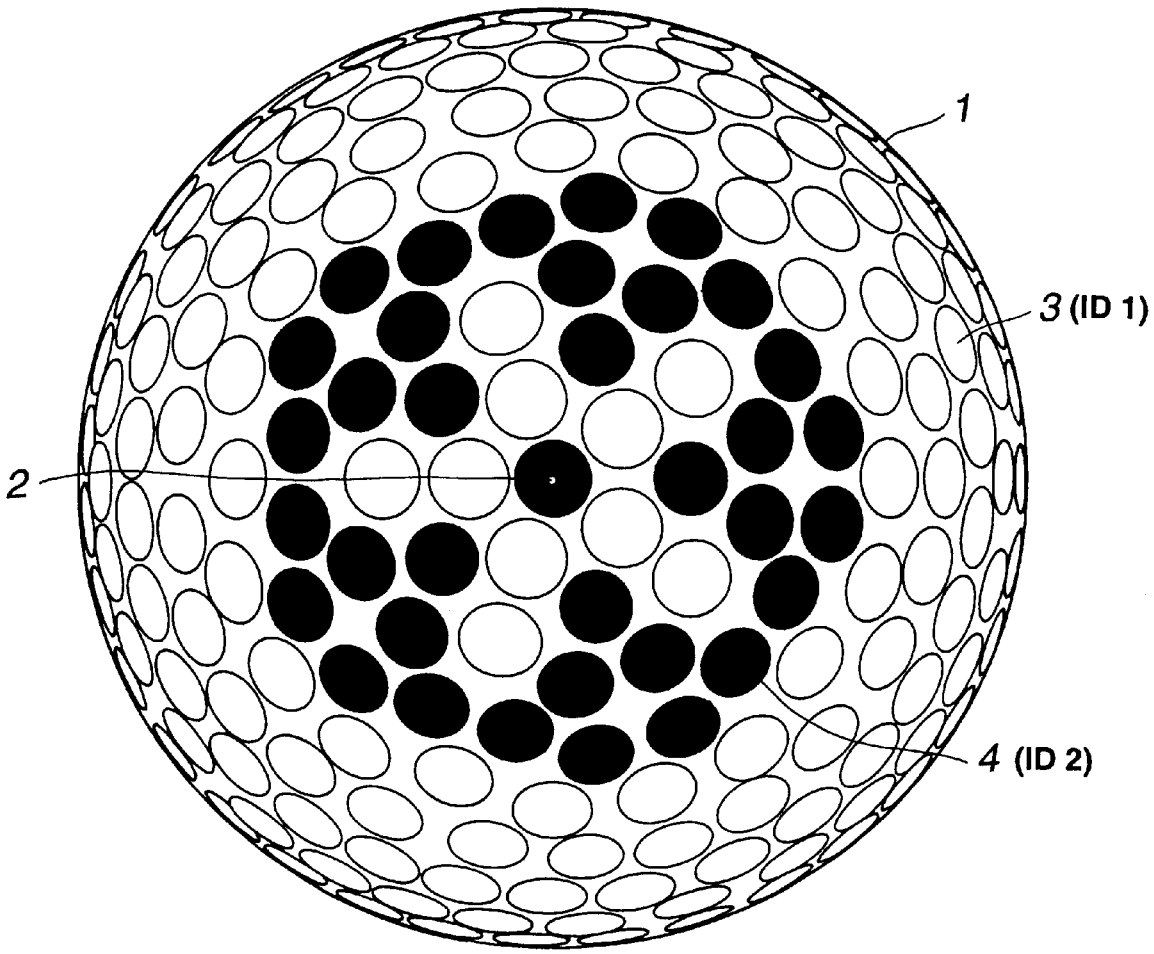
FIG. 3 schematically illustrates the pattern of dimple arrangement on a golf ball used in Example 2.
Figure 4:
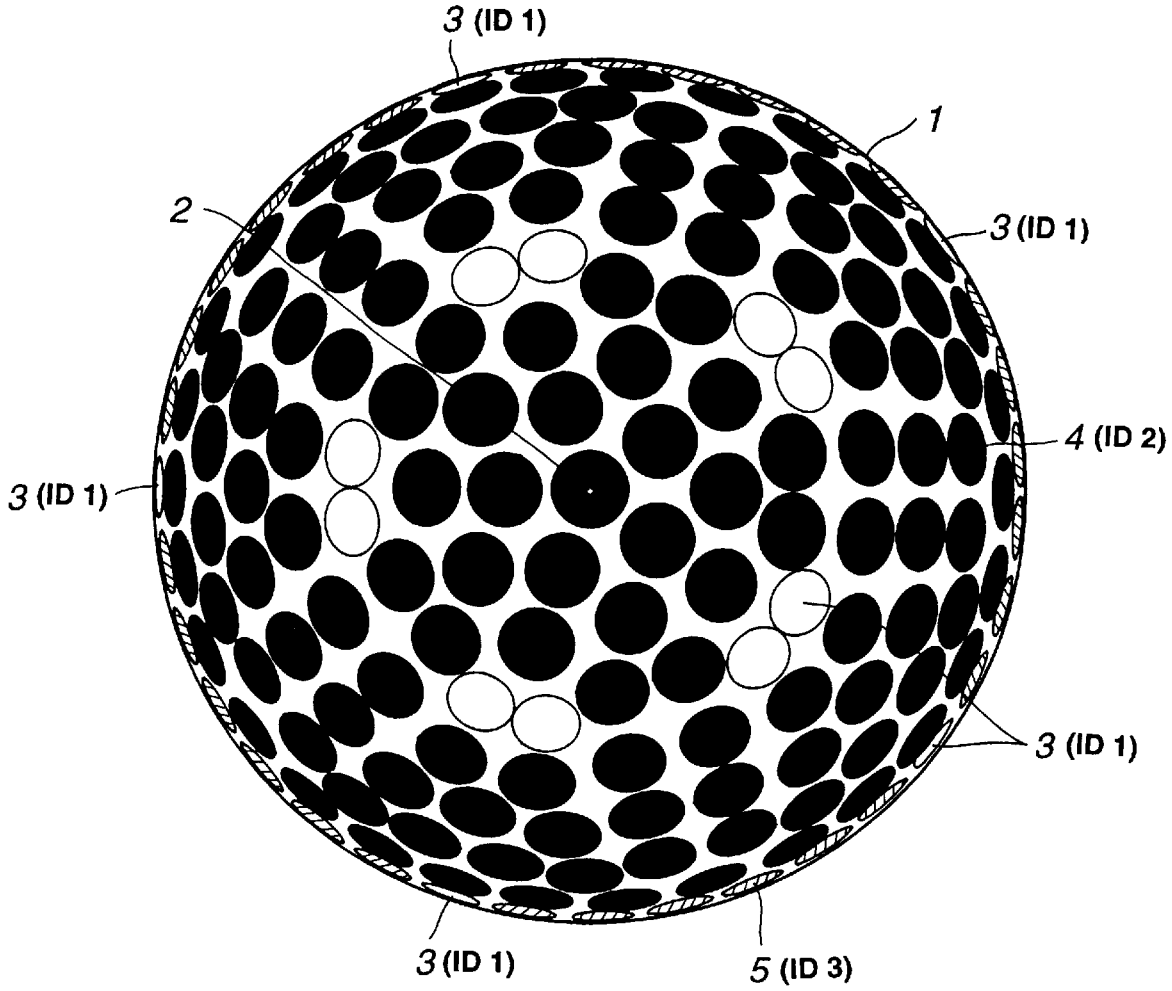
FIG. 4 schematically illustrates the pattern of dimple arrangement on a golf ball used in Example 3.
Figure 5:
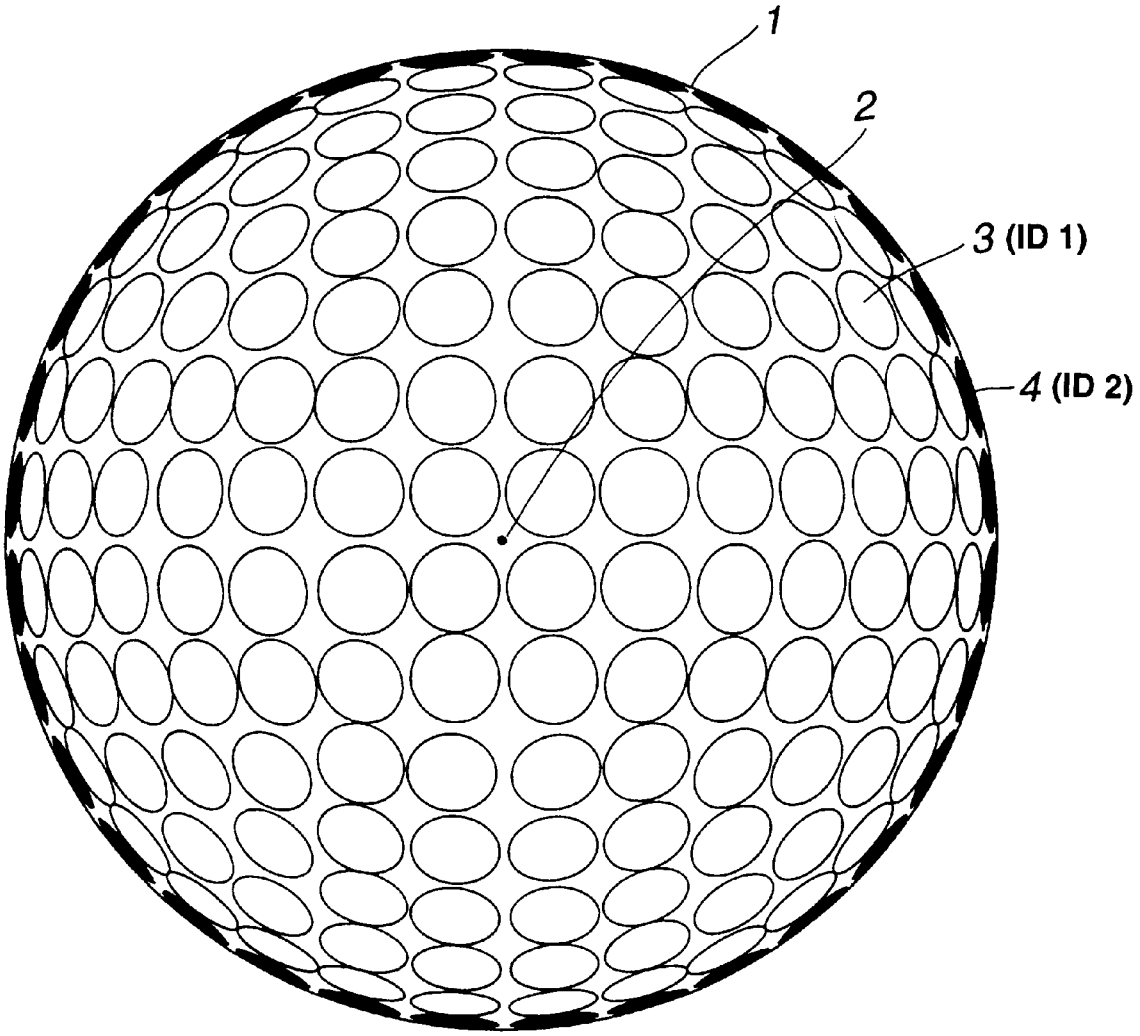
FIG. 5 schematically illustrates the pattern of dimple arrangement on a golf ball used in Comparative Example 1.

| Dimple | E1 | | E2 | | E3 | | | CE1 | |
|---|---|---|---|---|---|---|---|---|---|
| Types | 2 | | 2 | | 3 | | | 2 | |
| Arrangement | FIG. 2 | | FIG. 3 | | FIG. 4 | | | FIG. 5 | |
| Parameter | | | | | | | | | |
| ID | 1 | 2 | 1 | 2 | 1 | 2 | 3 | 1 | 2 |
| Number | 24 | 332 | 300 | 72 | 30 | 262 | 60 | 272 | 64 |
| Diameter (mm) | 3.20 | 3.80 | 3.66 | 3.42 | 3.38 | 3.76 | 3.60 | 3.77 | 3.71 |
| Volume ($mm^3$) | 0.705 | 0.995 | 0.966 | 0.843 | 0.795 | 1.095 | 1.056 | 1.100 | 1.100 |
| Total number | 356 | | 372 | | 352 | | | 336 | |
| Area occupation (%) | 69.2 | | 66.7 | | 66.2 | | | 65.2 | |
| Volume occupation (%) | 0.85 | | 0.86 | | 0.92 | | | 0.91 | |
| Ni | 1.010 | | 0.993 | | 1.003 | | | 0.997 | |
| Li | 1.006 | | 0.999 | | 0.999 | | | 0.995 | |
| Si | 1.002 | | 1.005 | | 0.997 | | | 0.994 | |
| Vi | 1.002 | | 1.005 | | 1.014 | | | 0.997 | |
| Remarks | *1 | | *2 | | *3 | | | *4 | |

*1 All indexes Vi, Si, Li and Ni had values in the preferred ranges.
*2 Two indexes Vi and Si had values in the preferred ranges.
*3 Two indexes Vi and Ni had values in the preferred ranges.
*4 All indexes Vi, Si, Li and Ni had values of less than 1.

Figure 6A:
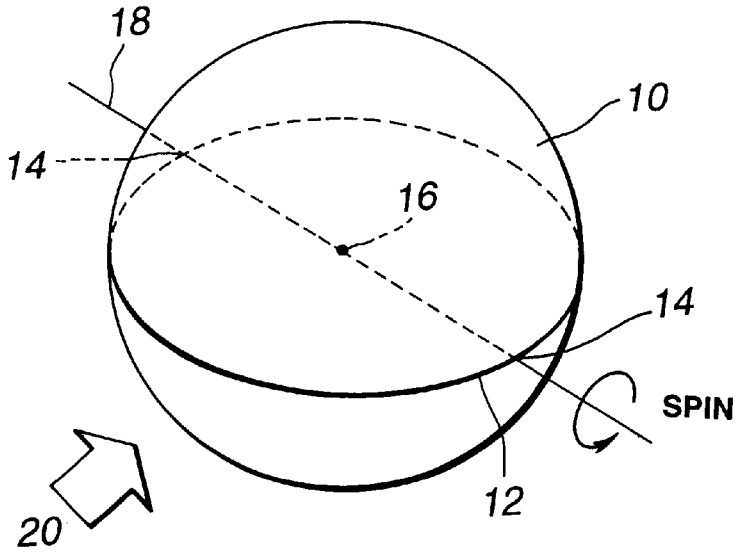
FIG. 6 illustrates the direction in which a golf ball is hit by a club, FIG. 6(A) corresponding to pole hitting and FIG. 6(B) corresponding to seam hitting.
Figure 6B:
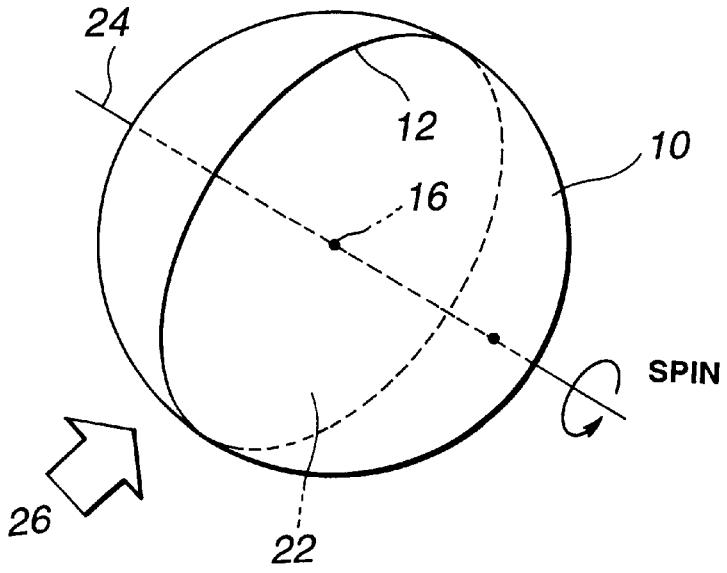

These golf balls were subject to a hitting test. The balls were repeatedly hit with a driver (#W1) at a head speed (HS) of 45 m/sec. by pole hitting (in the direction of an arrow in FIG. 6(A)) and seam hitting (in the direction of an arrow in FIG. 6(B)). The carry, run and total travel distance (expressed in meter) were measured, and the trajectory was observed for comparison. The results are shown in Table 2.

TABLE 2

| | Pole hitting carry | Seam hitting carry | Pole hitting run | Seam hitting run | Pole hitting total | Seam hitting total | Remarks |
|---|---|---|---|---|---|---|---|
| E1 | 216 | 216 | 17 | 16 | 233 | 232 | *1 |
| E2 | 214 | 215 | 16 | 16 | 230 | 231 | *2 |
| E3 | 213 | 215 | 16 | 15 | 229 | 230 | *2 |
| CE1 | 217 | 212 | 13 | 15 | 230 | 227 | *3 |

*1 No difference was found in trajectory between pole hitting and seam hitting.
*2 The trajectory was substantially the same between pole hitting and seam hitting.
*3 The trajectory on pole hitting was significantly higher than on seam hitting.

The results of the hitting test as reported in Table 2 are discussed below.

(1) The golf ball of Comparative Example 1 flew a higher trajectory on pole hitting than on seam hitting, resulting in a difference in carry and total travel distance. The ball trajectory was apparently different to the naked eyes between pole hitting and seam hitting.

(2) In the golf ball of Example 1, all the symmetry indexes Ni, Li, Si, and Vi were regulated to preferred values in excess of 1. The ball showed no difference in trajectory between pole hitting and seam hitting, indicating best symmetry.

(3) The golf balls of Examples 2 and 3 showed good symmetry because two (inclusive of Vi) of the symmetry indexes Ni, Li, Si, and Vi were regulated to preferred values in excess of 1.

It was demonstrated by these test results that the golf balls of the invention are improved in symmetry in that they would follow the same trajectory regardless of pole hitting or seam hitting and their flight performance would not vary with a particular point of impact.

As mentioned above, the present invention ensures golf balls of improved symmetry in which the inconvenience that flight characteristics depend on a particular point of impact is eliminated by correcting the difference in trajectory between points of impact which is derived from a difference in roundness of the ball.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having a plurality of dimples in its surface which is molded using a mold comprising a pair of mold halves defining a hemispherical cavity and adapted to be removably mated along a parting line to define a spherical cavity therein, wherein provided that the ball surface has an equator line corresponding to the mold parting line and poles at apexes opposed with respect to the equator line, the number of the dimples is n, a center of each dimple has coordinates (θj, ϕj) as represented by the latitude (in radian) and longitude of the ball, said dimple has a radius rj and a volume vj, and symmetry indexes Vi, Si, Li, and Ni are represented by the following equations (1) to (4):

$$\text{volume symmetry index } Vi = \frac{\sum_{j=1}^{n} vj\theta j}{\sum_{j=1}^{n} vj} \quad (1)$$

$$\text{area symmetry index } Si = \frac{\sum_{j=1}^{n} rj^2\theta j}{\sum_{j=1}^{n} rj^2} \quad (2)$$

$$\text{edge length symmetry index } Li = \frac{\sum_{j=1}^{n} rj\theta j}{\sum_{j=1}^{n} rj} \quad (3)$$

$$\text{array symmetry index } Ni = \frac{\sum_{j=1}^{n} \theta j}{\sum_{j=1}^{n} 1} \quad (4)$$

the following condition (A):

(A) Vi>1 is satisfied and at least one of the following conditions (B) to (D):

(B) Ni>1, (C) Li>1, and (D) Si>1 is satisfied, and the golf ball does not have dimples which intercept said equator line.

2. The golf ball of claim 1 wherein all of conditions (B) to (D) are satisfied.

3. The golf ball of claim 1 wherein 1.001≦Vi≦1.025.

4. The golf ball of claim 3 wherein 1.001≦Ni≦1.015, 1.001≦Li≦1.025 and 1.001≦Si≦1.025.

5. The golf ball of claim 1 wherein all the dimples occupy at least 65% of the ball surface.

6. The golf ball of claim 5, wherein the number of dimples is in the range of 318 to 500 dimples.

7. The golf ball of claim 1, wherein said dimple radius rj is in the range of 1.0 to 2.25 mm.

8. The golf ball of claim 1, wherein said dimple volume vj is in the range of 0.3 to 1.5 $mm^3$.

9. The golf ball of claim 1, wherein said dimples have a depth in the range of 0.05 to 0.3 mm.

* * * * *